US005761836A

United States Patent [19]

Dawson

[11] Patent Number: 5,761,836

[45] Date of Patent: Jun. 9, 1998

[54] CARD ASSEMBLY

[75] Inventor: Michael Dawson, Dublin, Ireland

[73] Assignee: PEM Promotions Limited, Dublin, Ireland

[21] Appl. No.: 682,542

[22] PCT Filed: May 3, 1994

[86] PCT No.: PCT/IE94/00023

§ 371 Date: Jul. 25, 1996

§ 102(e) Date: Jul. 25, 1996

[87] PCT Pub. No.: WO95/19893

PCT Pub. Date: Jul. 27, 1995

[30] Foreign Application Priority Data

Jan. 25, 1994 [IE] Ireland ..... S940068

[51] Int. Cl.[6] ..... G09F 1/00

[52] U.S. Cl. ..... 40/124.03; 40/124.11; 283/117

[58] Field of Search ..... 40/124.03, 124.11, 40/124.12, 455, 717, 906; 229/92.8; 283/117; 340/384.1, 384.6

[56] References Cited

U.S. PATENT DOCUMENTS

| | | | |
|---|---|---|---|
| 2,504,277 | 4/1950 | Otterson | 40/124.11 |
| 2,547,359 | 4/1951 | Bacharach | 40/124.11 X |
| 3,092,927 | 6/1963 | Luchsinger . | |
| 3,594,937 | 7/1971 | Luchsinger . | |
| 3,798,806 | 3/1974 | Sanford . | |
| 4,055,014 | 10/1977 | Schmidt et al. . | |
| 4,209,824 | 6/1980 | Kaufman . | |
| 4,222,188 | 9/1980 | Tarrant et al. . | |
| 4,286,399 | 9/1981 | Funahashi et al. . | |
| 4,299,041 | 11/1981 | Wilson | 40/124.03 X |
| 4,363,081 | 12/1982 | Wilbur . | |
| 4,480,250 | 10/1984 | McNeely . | |
| 4,497,126 | 2/1985 | Dejean . | |
| 4,531,310 | 7/1985 | Acson et al. | 40/455 X |
| 4,607,747 | 8/1986 | Steiner . | |
| 4,611,262 | 9/1986 | Galloway et al. . | |
| 4,703,573 | 11/1987 | Montgomery et al. . | |
| 4,781,379 | 11/1988 | Parks . | |
| 4,791,741 | 12/1988 | Kondo . | |
| 4,796,750 | 1/1989 | Inghram . | |
| 4,866,865 | 9/1989 | Yang . | |
| 5,034,724 | 7/1991 | Tone . | |
| 5,053,749 | 10/1991 | Weiss . | |
| 5,053,750 | 10/1991 | Alex . | |
| 5,063,698 | 11/1991 | Johnson et al. . | |
| 5,133,496 | 7/1992 | Davidson et al. . | |
| 5,139,454 | 8/1992 | Earnest . | |
| 5,245,171 | 9/1993 | Fox et al. . | |
| 5,275,285 | 1/1994 | Clegg . | |

FOREIGN PATENT DOCUMENTS

| | | |
|---|---|---|
| A 2 137 560 | 10/1984 | United Kingdom . |
| A 2 155 858 | 2/1985 | United Kingdom . |

*Primary Examiner*—Brian K. Green
*Attorney, Agent, or Firm*—Hoffmann & Baron, LLP

[57] ABSTRACT

A greeting or other card plays an appropriate aural message and serves as a presentation vehicle for a gift or other article such as a lottery ticket. The card includes a device for playing a tune or verbal message and has mounting slots for the article. When seated in the slots, the article interrupts the electrical circuit of the device, preventing playback of the tune or message. On removal of the article, a switch of the device closes to complete an electrical circuit which causes the aural greeting to sound.

13 Claims, 2 Drawing Sheets

CARD ASSEMBLY

BACKGROUND OF THE INVENTION

1. Field of the Invention

The present invention relates to a card, and in particular to a card for presentation of a gift or other item.

2. Description of the Prior Art

Greeting cards which play a tune when opened are well-known in the art and are popular with the public. Exemplary such cards are birthday greeting cards which, when opened play an appropriate tune, such as "Happy Birthday" or "Congratulations". These cards are provided with a miniature battery powered printed circuit board (PCB) having a memory chip with tone instructions, a piezo-electric buzzer and a switch. One side of the switch is connected to one battery terminal. The other side of the switch is integral with the PCB. When the card is closed, the switch is off. Opening the card causes the switch to make contact, thereby closing the circuit so that the tune is sounded.

SUMMARY OF THE INVENTION

An object of the present invention is to provide a card which also serves as a vehicle for presenting a gift or other token.

Accordingly, the present invention provides a card assembly comprising a card-member and means associated with the card-member for delivering an aural message, characterised in that the assembly further includes means associated with the card-member for detachably mounting an article on the card-member and switch means associated with the mounting means for controlling the message delivery means, whereby on detachment of the article from the card-member, the switch means actuates the message delivery means, to deliver the aural message. The message delivery means may comprise an electrical circuit including a power supply means, a printed circuit board for generating a signal representing the message and a piezo-electric buzzer for converting the signal into aurally detectable tones.

In an embodiment of an assembly according to the invention, the switch means is associated with the mounting means so that the article when mounted on the card-member retains the switch means in an open or closed position, whereby detachment of the article from the card-member respectively closes or opens an electrical circuit to control operation of the message delivery means. In a preferred embodiment the switch means is retained in an open position by the article and on detachment of the article, the switch means closes to actuate the message delivery means. In a particularly preferred embodiment the card-member includes a pair of leaves between which is located the message delivery means and the switch means and one of the leaves has an aperture about the terminals of the switch means to enable a part of the article to be interposed between the terminals to interrupt the circuit. The assembly may include a third leaf closable against the apertured leaf.

In the assembly, secondary control means are advantageously provided for controlling the switch means in the absence of the article, the secondary control means being movable relative to the card-member to control the switch means.

Supplementary mounting means may be associated with the card-member for detachably mounting a further article thereto.

The card may be a greeting card, in which case the article is preferably a gift item, for example a lottery scratch card, ticket, photograph, compact disc, bank note, cheque or the like and the aural message may be a tune appropriate to the occasion which the gift is intended to mark.

Alternatively, the article may be any item which is generally delivered to its recipient attached to a letter, card or the like, for example a credit card, a bank card or a personal identification card.

The card may be a flat card such as a postcard or may have two or more leaves which fold together. The card itself, together with the musical or vocal message it contains, is appropriately designed and selected to mark a given occasion. The card may also be a vehicle for delivery of a commercial message and the terms "card" and "greeting card" should be understood accordingly. Additionally, the term "card" should be understood to include any suitable materials, including stiff and flexible materials whether fabricated from paper, cardboard, plastics material, metal or otherwise.

For example, the card may be a Christmas or birthday card and carry a tune complementary to that occasion. Other examples of occasions which can be marked with such cards are:

St. Valentines' day

New Years' day or other national holiday wedding day birth of a baby anniversary day sporting occasion "get well" wish holiday greeting As an alternative to a musical jingle, the card may deliver a verbal message, for example a Corporate message, verbal information or greeting and the like.

The invention will now be more particularly described with reference to the accompanying drawings which show, by way of example only, one embodiment of a card according to the invention.

DESCRIPTION OF THE PREFERRED EMBODIMENTS

Figure 1:
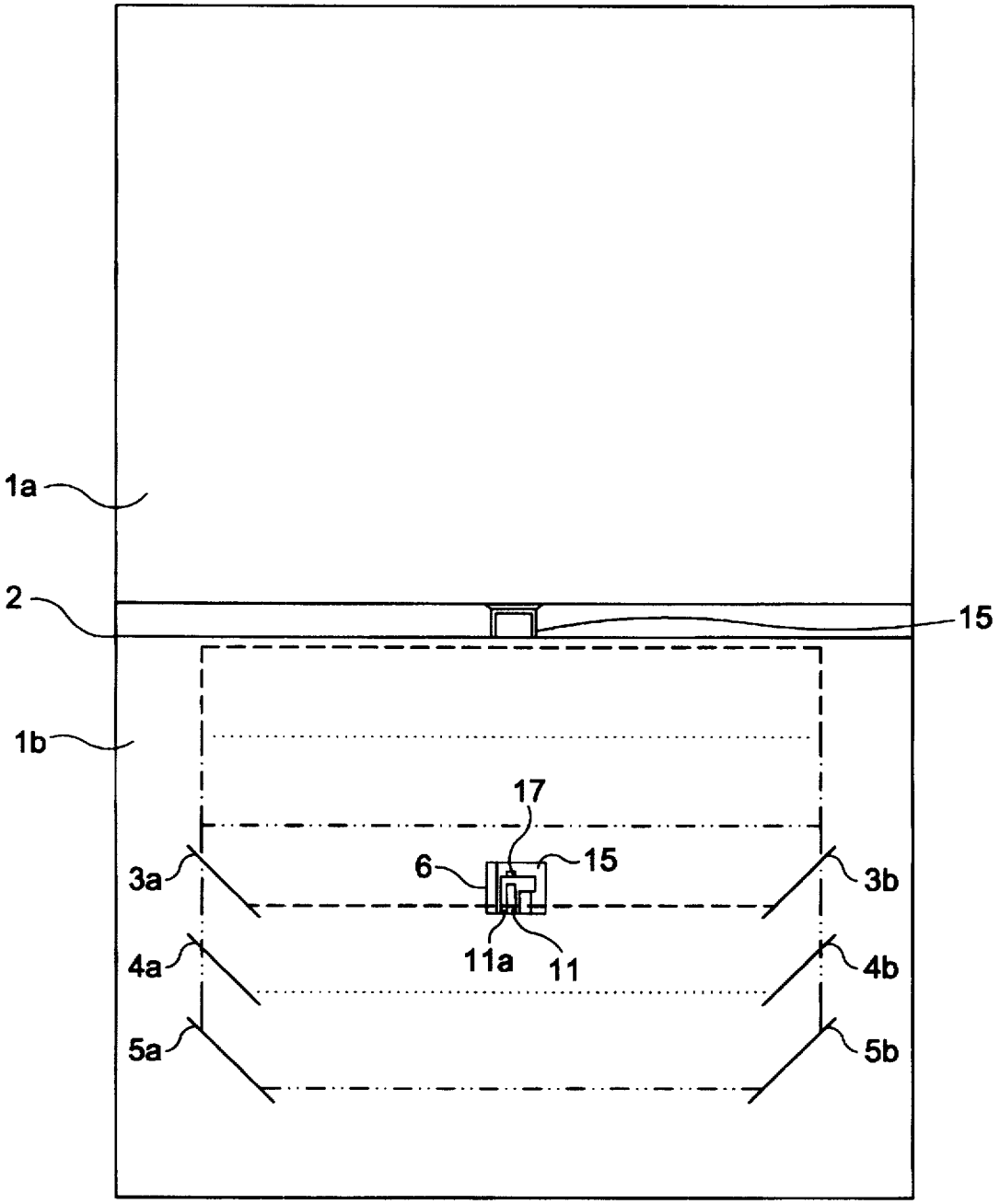
FIG. 1 is a plan view of an opened out, two-leaved greeting card according to the invention.
Figure 2:
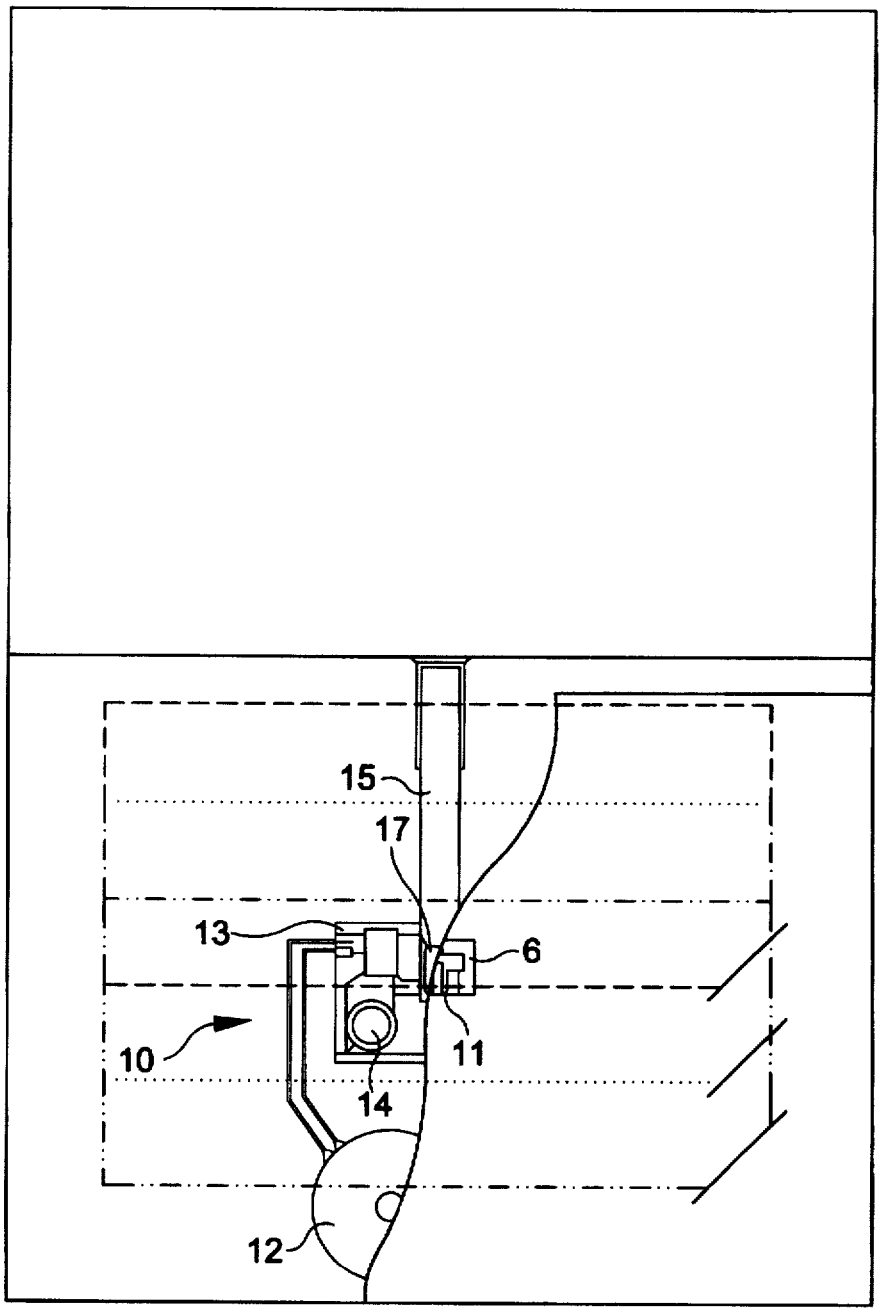
FIG. 2 is a view similar to that of FIG. 1, partially cut away.

Referring to the figures, a greeting card comprises two leaves 1*a* and 1*b* which fold together along the fold line 2. The leaf 1*b* has a pair of diagonal slots 3*a*, 3*b* for receiving a gift article, such as a lottery ticket or a concert ticket, as shown by the dashed line. Further gifts may be accommodated by the slots 4*a*, 4*b* or 5*a*, 5*b* (closed and opened dotted lines respectively). A window or aperture 6 in the leaf 1*b* gives access to the switch 11 of a message delivery device 10. Any desired number of slot pairs may be provided.

The device 10, which plays a tune, comprises a piezo-electric buzzer 12 connected to a printed circuit board (PCB) 13, a power supply means such as a battery 14 and a switch 11, which has a connecting stud 11*a*. One battery terminal is provided as a pad on the PCB 13, the other being connected to the switch 11. The switch 11 comprises resiliently deformable conductive material which is biased into contact with the PCB to close the circuit. The gift item is placed in the slots 3a, 3b and between the PCB 13 and switch 11, thereby maintaining the circuit open. On removal of the gift, the stud 11a of the switch 11 connects with the PCB 13 to close the circuit, causing the buzzer 12 to sound the tones comprising the tune.

Once the gift item has been removed from the card, the sounding of the tune may be shut off by means of the arm 15, which is fixed at one end to the leaf 1a in such manner that the arm 15 is capable of limited movement along its longitudinal axis relative to the leaf 1b on folding of the leaf 1a relative to leaf 1b. At its free end, the arm 15 has an aperture 17. When the card is closed, leaves 1a and 1b lie superimposed on and facing one another, with the arm 15 interposed between PCB 13 and the switch 11 to keep the switch open. On opening the card, the arm 15 moves along its longitudinal axis, bringing the aperture 17 into register with the stud 11a of the switch 11, thereby allowing the circuit to close for playing the tune. Closure of the card shuts-off the sound by moving the aperture 17 out of register with the stud 11a and re-interposing the arm 15 to shut the switch.

For practical purposes, the leaf 1b is preferably provided as a two-layered leaf, with the device 10 sandwiched between the layers and with the window 6 provided only in one of the layers, giving access to the switch for placement of the gift article.

In use, the card is presented to a recipient closed, with the gift (for example, a gift ticket) inserted in the slots 3a, 3b and interposed between the switch 11 and PCB 13. On opening of the card, the arm 15 moves so that the aperture 17 comes into register with the switch 11. However, as the gift ticket is holding the switch open, the tune does not play. Only when the recipient removes the gift ticket from the slots 3a, 3b does the congratulatory or other tune sound. Thereafter, the tune may be shut off in the normal way by closing the card. On subsequent opening of the card after removal of the gift ticket, the tune will play as the aperture 17 moves into register to allow the circuit to close.

Any suitable power supply means, for example, a solar cell, may be used in place of a battery in the device.

While the invention has been particularly described with reference to a two-leaved card, it will be appreciated that with appropriate modifications, it can equally be applied to a single leaf card, such as a postcard, or indeed to multi-leaved cards. Equally, it will be appreciated that the shut-off arm 15 may be arranged so as to be directly manually operable.

The card, which need not be a greeting card, may also optionally be provided with a device 10 associated with each pair of mounting slots, the devices playing the same or a different message and each having independent secondary shut off arms whereby removal of each gift item causes a message to be played. The message played will usually be of a musical nature, but may equally comprise a verbal message. Additionally, the article held on the card need not be a gift item but may equally be some other article to be delivered to a recipient, for example, a credit card.

It will of course be understood that the invention is not limited to the specific details described herein, which are given by way of example only, and that various modifications and alterations are possible within the scope of the invention as defined in the appended claims.

What is claimed is:

1. A greeting card assembly adapted for presentation of a separate gift article to a recipient, said card assembly comprising:

a card-member;

an annular message delivery device, said aural message delivery device being secured to said card member;

removable attachment means for removably attaching the gift article to said card-member, said removable attachment means being secured to said card member;

a switch, said switch being secured to said card-member adjacent said removable attachment means, said switch having a first switch position when the gift article is attached to said card-member, said aural message delivery device being unactuated in said first switch position of said switch, said switch having a second switch position, said aural message delivery device being actuated in said second switch position of said switch, said switch including first and second contacts; and a secondary control member which is secured to said card-member, said secondary control member having a first member state in which said secondary control member causes said switch to assume said first switch position even when the gift article is not attached to said card-member, said secondary control member having a second member state in which said secondary control member causes said switch to assume said second switch position when the gift article is removed from said card-member but does not cause said switch to assume said second switch position when the gift article is attached to said card member, said secondary control member being located between said first and second contacts;

whereby on initial detachment of the gift article from said card-member, said switch actuates said aural message delivery device, to deliver an aural message.

2. An assembly according to claim 1, in which said aural message delivery device comprises an electrical circuit including a power supply, a printed circuit board for generating a signal representing the message and a piezoelectric buzzer for converting the signal into aurally detectable tones.

3. An assembly according to claim 1, in which the gift article, when attached to said card-member, retains said switch in one of an open and a closed position, whereby detachment of the gift article from said card-member respectively closes or opens an electrical circuit to control operation of said aural message delivery device, subject to said secondary control member.

4. An assembly according to claim 3, in which said switch is retained in an open position by the gift article, and on detachment of the gift article, said switch closes to actuate said aural message delivery device, subject to said secondary control member.

5. An assembly according to claim 4, wherein:

said card-member includes first and second leaves between which are located said aural message delivery device and said switch;

said switch has terminals; and said second leaf has an aperture about said terminals of said switch to enable a part of the gift article to be interposed between said terminals to interrupt said circuit.

6. An assembly according claim 5, further comprising a third leaf closable against said second leaf which has said aperture.

7. An assembly according claim 1, wherein said secondary control member is movably secured to said card-member to control said switch.

8. An assembly according to claim 1, further comprising supplementary removable attachment means for removably attaching a further gift article to said card-member, said supplementary removable attachment means being secured to said card-member.

9. In combination:

a gift article; and a greeting card assembly adapted for presentation of said gift article to a recipient, said card assembly comprising:

a card-member;

an aural message delivery device, said aural message delivery device being secured to said card member;

removable attachment means for removably attaching said gift article to said card-member, said removable attachment means being secured to said card member;

a switch, said switch being secured to said card-member adjacent said removable attachment means, said switch having a first switch position when said gift article is attached to said card-member, said aural message delivery device being unactuated in said first switch position of said switch, said switch having a second switch position, said aural message delivery device being actuated in said second switch position of said switch, said switch including first and second contacts; and a secondary control member which is secured to said card-member, said secondary control member having a first member state in which said secondary control member causes said switch to assume said first switch position even when said gift article is not attached to said card-member, said secondary control member having a second member state in which said secondary control member causes said switch to assume said second switch position when said gift article is removed from said card-member but does not cause said switch to assume said second switch position when said gift article is attached to said card member, said secondary control member being located between said first and second contacts;

whereby on initial detachment of said gift article from said card-member said switch actuates said aural message delivery device, to delivery an aural message.

10. A greeting card assembly adapted for presentation of a separate gift article, in the form a ticket having at least one edge, to a recipient, said card assembly comprising:

a card member including:

a first generally planar leaf having an upper edge, an inner face and an outer face;

a second generally planar leaf having an upper edge, an inner face and an outer face, said second generally planar leaf being formed with a leaf aperture therethrough, said first and second leaves being secured to each other on said inner faces to form said card-member, said second generally planar leaf having at least first and second ticket securing slots formed therein and positioned to receive the at least one edge of the ticket and to hold the edge adjacent said leaf aperture with the ticket retained against said outer face of said second generally planar leaf;

an aural message delivery device sandwiched between said inner faces of said first and second leaves;

a switch which is sandwiched between said inner faces of said first and second leaves, said switch being interconnected with said aural message delivery device for actuation of said aural message delivery device, said switch having normally closed spaced electrical contacts aligned with said leaf aperture to receive the edge of the ticket, the edge of the ticket separating said contacts to prevent actuation of said aural message delivery device, said contacts of said switch actuating said aural message delivery device when normally closed; and a third generally planar leaf hingedly secured to at least one of said upper edge of said first generally planar leaf and said upper edge of said second generally planar leaf, said third leaf being movable between a first position wherein said outer face of said second leaf and the ticket are covered and a second position wherein said outer face of said second leaf and the ticket are revealed to the recipient.

11. The greeting card assembly of claim 10, further comprising:

a shut off arm having first and second ends, said first end being secured to said third leaf, said second end being formed with an arm aperture therethrough and being positioned adjacent said leaf aperture and said contacts of said switch such that said contacts of said switch are aligned with said arm aperture when said third leaf is in said second position and such that said contacts of said switch are separated from each other when said third leaf in said first position;

whereby said aural message delivery device is activated when both of the following conditions occur:

the ticket is not secured in said slots; and said third leaf is in said second position; and said aural message delivery device is not activated when at least one of the following two conditions occurs:

the ticket is secured in said slots with the edge adjacent said leaf aperture; and said third leaf is in said first position.

12. In combination:

a gift article in the form of a ticket having at least one edge; and a greeting card assembly adapted for presentation of said ticket to a recipient, said card assembly comprising;

a card member including:

a first generally planar leaf having an upper edge, an inner face and an outer face;

a second generally planar leaf having an upper edge, an inner face and an outer face, said second generally planar leaf being formed with a leaf aperture therethrough, said first and second leaves being secured to each other on said inner faces to form said card-member, said second generally planar leaf having at least first and second ticket securing slots formed therein and positioned to receive said at least one edge of said ticket and to hold said edge adjacent said leaf aperture with said ticket retained against said outer face of said second generally planar leaf, an aural message delivery device sandwiched between said inner faces of said first and second leaves;

a switch which is sandwiched between said inner faces of said first and second leaves, said switch being interconnected with said aural message delivery device for actuation of said aural message delivery device, said switch having normally closed spaced electrical contacts aligned with said leaf aperture to receive said edge of said ticket, said edge of said ticket separating said contacts to prevent actuation of said aural message delivery device, said contacts of said switch actuating said aural message delivery device when normally closed; and a third generally planar leaf hingedly secured to at least one of said upper edge of said first generally planar leaf and said upper edge of said second generally planar leaf, said third leaf being movable between a first position wherein said outer face of said second leaf and said ticket are covered and a second position wherein said outer face of said second leaf and said ticket are revealed to the recipient.

13. The combination of claim 12, further comprising:

a shut off arm having first and second ends, said first end being secured to said third leaf, said second end being formed with an arm aperture therethrough and being positioned adjacent said leaf aperture and said contacts of said switch such that said contacts of said switch are aligned with said arm aperture when said third leaf is in said second position and such that said contacts of said switch are separated from each other when said third leaf in said first position;

whereby said aural message delivery device is activated when both of the following conditions occur:

said ticket is not secured in said slots; and said third leaf is in said second position; and said aural message delivery device is not activated when at least one of the following two conditions occurs:

said ticket is secured in said slots with said edge adjacent said leaf aperture; and said third leaf is in said first position.

* * * * *